US007775747B2

(12) United States Patent
Bott

(10) Patent No.: US 7,775,747 B2
(45) Date of Patent: Aug. 17, 2010

(54) MULTI-COMPONENT RETAINING WALL BLOCK

(75) Inventor: Timothy A. Bott, Sunfish Lake, MN (US)

(73) Assignee: Allan Block Corporation, Edina, MN (US)

( * ) Notice: Subject to any disclaimer, the term of this patent is extended or adjusted under 35 U.S.C. 154(b) by 0 days.

(21) Appl. No.: 12/265,314

(22) Filed: Nov. 5, 2008

(65) Prior Publication Data

US 2010/0111615 A1 May 6, 2010

(51) Int. Cl.
*E02D 29/02* (2006.01)

(52) U.S. Cl. ..... 405/286; 405/284; 52/606; 52/604

(58) Field of Classification Search ..... 405/262, 405/284, 286; 52/604, 596, 606
See application file for complete search history.

(56) References Cited

U.S. PATENT DOCUMENTS

| | | | | | |
|---|---|---|---|---|---|
| 3,464,211 | A | | 9/1969 | Andersen | |
| 4,597,236 | A | | 7/1986 | Braxton | |
| 4,815,897 | A | * | 3/1989 | Risi et al. | 405/284 |
| 4,896,999 | A | | 1/1990 | Ruckstuhl | |
| 4,909,010 | A | | 3/1990 | Gravier | |
| 5,315,802 | A | | 5/1994 | Hart | |
| 5,350,256 | A | | 9/1994 | Hammer | |
| 5,474,405 | A | * | 12/1995 | Anderson et al. | 405/286 |
| 5,484,236 | A | | 1/1996 | Gravier | |
| 5,623,797 | A | | 4/1997 | Gravier et al. | |
| 5,688,078 | A | | 11/1997 | Hammer | |
| 5,707,184 | A | * | 1/1998 | Anderson et al. | 405/286 |
| 5,788,423 | A | | 8/1998 | Perkins | |
| 5,820,304 | A | | 10/1998 | Sorheim et al. | |
| 5,878,545 | A | | 3/1999 | Gebhart | |
| 6,062,772 | A | | 5/2000 | Perkins | |
| 6,082,067 | A | | 7/2000 | Bott | |
| 6,082,933 | A | * | 7/2000 | Maguire et al. | 405/286 |
| D459,487 | S | | 6/2002 | Bott | |
| 6,523,317 | B1 | | 2/2003 | Bott et al. | |
| 6,854,236 | B2 | | 2/2005 | Bott | |
| 6,948,282 | B2 | | 9/2005 | Bott | |
| 7,410,328 | B2 | | 8/2008 | Hamel | |
| 2004/0161307 | A1 | | 8/2004 | Hammer | |
| 2007/0196184 | A1 | | 8/2007 | Hammer et al. | |
| 2007/0292216 | A1 | | 12/2007 | Hamel | |

FOREIGN PATENT DOCUMENTS

| | | | |
|---|---|---|---|
| EP | 112213 | * | 6/1984 |

OTHER PUBLICATIONS

Brochure, "The next generation segmental retaining wall system . . . Gravity Stone", Westblock Products, Inc., patent pending 1992, 3 pages.

* cited by examiner

*Primary Examiner*—Frederick L Lagman
(74) *Attorney, Agent, or Firm*—Fredrikson & Bryon, P.A.

(57) ABSTRACT

A multi-component segmented retaining wall (SRW) block that may form a mortarless retaining wall. Each SRW block includes an interlocking face unit and an anchor unit that together form a vertically oriented hollow core bounded by the inner walls of the face unit and the anchor unit. Each face unit and anchor unit pair are interlocked by complementary connector elements.

31 Claims, 14 Drawing Sheets

MULTI-COMPONENT RETAINING WALL BLOCK

TECHNICAL FIELD

The present disclosure pertains segmented retaining wall block, and more particularly to a multi-component segmented retaining wall block.

BACKGROUND

Retaining walls are commonly employed to retain highly positioned soil, such as soil forming a hill, to provide a usable level surface therebelow such as for playgrounds and yards, or to provide artificial contouring of the landscape which is aesthetically pleasant. Such walls have been made of concrete blocks having various configurations, the blocks generally being stacked one atop another against an earthen embankment with the wall formed by the blocks extending vertically or being formed with a setback. Setback is generally considered to be the distance in which one course of a wall extends beyond the front of the next highest course of the same wall. Concrete blocks have been used to create a wide variety of mortared and mortarless walls. Such blocks are often produced with a generally flat rectangular surface for placement onto the ground or other bearing foundation and for placement onto lower blocks in erecting the wall. Such blocks are also often further characterized by a frontal flat or decoratable surface and a flat planar top for receiving and bearing the next course of blocks forming the wall.

It is generally desired that retaining walls of the type described exhibit certain favorable characteristics, among which may be mentioned the ease with which the retaining wall can be assembled, the stability of the wall (that is, its ability to maintain structural integrity for long periods of time), and the ability of the wall to admit and disburse rainwater. Although retaining wall blocks commonly are supported vertically by resting upon each other, it is important that the blocks be restrained from moving outwardly from the earthen wall that they support.

Current manufacturing techniques and the economics associated therewith limit the shapes, sizes, and materials that may be used to manufacture blocks that still provide the functions described above. In some instances, it would be preferred to make blocks in different shapes, sizes, and colors, and using different quality, types, and price of materials, and possibly in a centralized location which may be further from their point of use. It is desirable to both break through these boundaries and yet produce improved retaining wall blocks.

SUMMARY OF THE INVENTION

Embodiments of the present disclosure pertain to a segmented retaining wall (SRW) block, and more particularly to a multi-component SRW block that forms a mortarless retaining wall. In certain embodiments, the mortarless wall is constructed of a plurality of multi-component SRWs stacked in an array of superimposed rows. Each SRW block includes a face unit and an anchor unit. The face unit has a facing surface defining part of the exposed surface of the retaining wall and it has two or more connector elements. The anchor unit has two connector elements that are of complementary shape to a respective face element connector element. The anchor unit is configured in the wall to confront soil being retained by the wall. The anchor unit and the face unit have upper and lower load bearing surfaces, where the upper surface is for mating with the lower surface of a super-imposed stacked block. The upper and lower surfaces are generally planar to resist shear forces between adjacent SRW blocks provided by the retained soil. The anchor unit and the face unit are interlocked via respective connector elements to form the SRW block, and, when interlocked, form a hollow core bounded by inner walls of the anchor unit. In some embodiments, the hollow core extends vertically from the upper surface to the lower surface. In some embodiments, the anchor unit or the face unit include an alignment element that aligns a superimposed SRW block relative to its immediately subjacent block and resists the shear forces between a superimposed SRW block relative to its immediately subjacent block.

In some embodiments, a supply of preformed block components are provided that can be used to form a mortarless retaining wall comprised of SRW blocks. The supply of block components includes a plurality of face units and a plurality of anchor units. Each face unit has a facing surface that defines part of the exposed surface of the retaining wall and the facing surfaces have different patterns. Each face unit has two connector elements. The anchor units are configured to confront soil being retained by the retaining wall, where each anchor unit is of a universal design and has two connector elements each being of complementary shape to the connector elements of the face units. Each anchor unit and face unit are capable of being interlocked via their respective connector elements to form one of the SRW blocks. When interlocked to form a SRW block, each anchor unit and face unit form a hollow core that is oriented vertically and bounded by the inner walls of the anchor unit and the face unit. The SRW blocks are stackable in rows to form the retaining wall.

In some embodiments, the multi-component SRW block may form a mortarless retaining wall. The SRW block includes a face unit and an anchor unit. The face unit has a facing surface and a rear surface opposite the facing surface. The facing surface defines part of the exposed surface of the retaining wall. The rear surface is generally planar and has recesses forming two connector elements. The anchor unit is generally U-shaped with first and second legs of the U-shape terminating in respective connector elements that are each of complementary shape to the face unit connector elements. The anchor unit is for confronting soil retained by the retaining wall. The anchor unit and the face unit each have upper and lower load bearing surfaces, where the upper surface is for mating with the lower surface of a super-imposed stacked block. The upper and lower surfaces are generally planar to resist shear forces between adjacent SRW blocks provided by the retained soil. The anchor unit and the face unit are interlocked via respective connector elements to form the SRW block, and, when interlocked, form a vertically oriented, hollow core bounded by inner walls of the anchor unit.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the invention.

Figure 1:
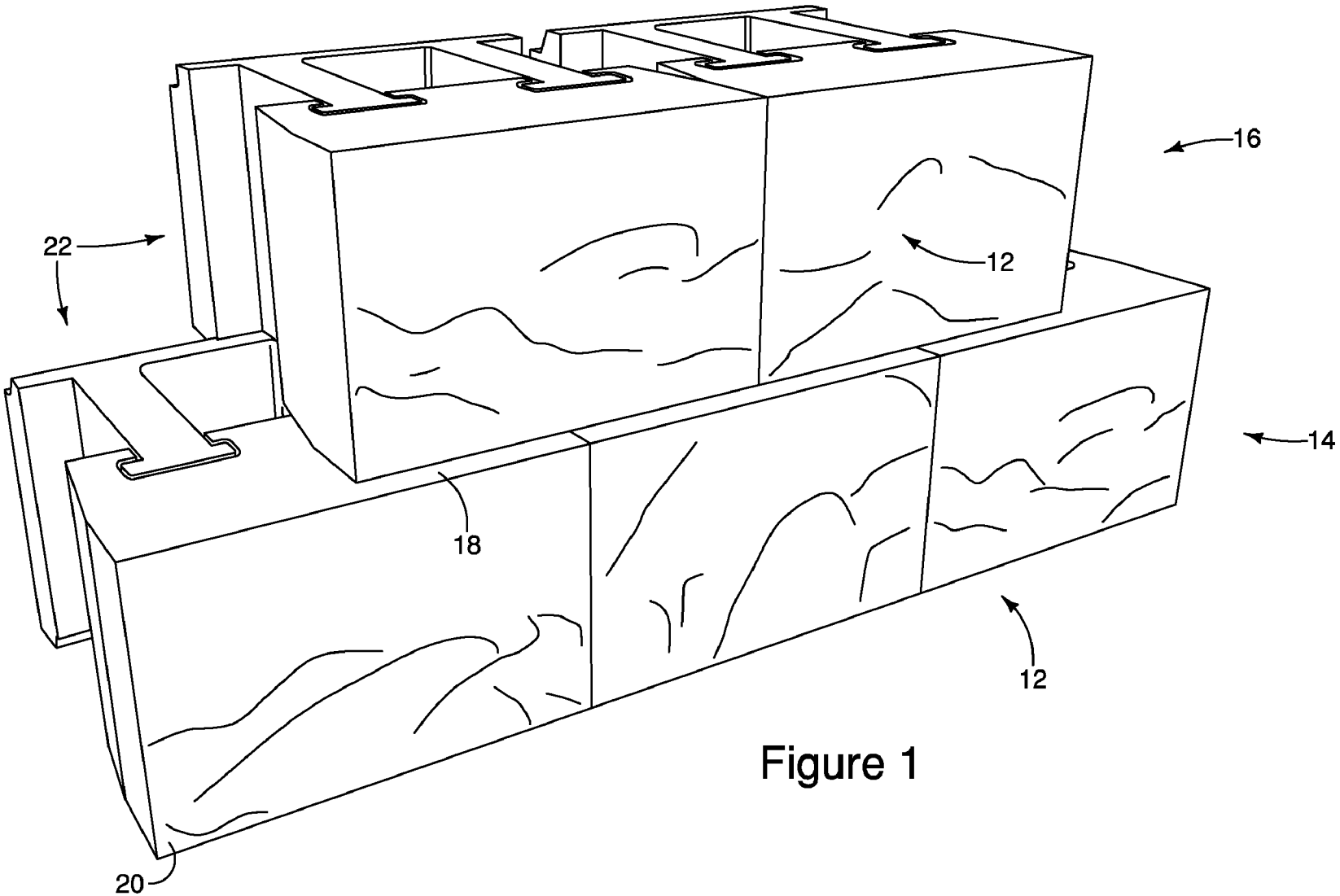
FIG. 1 is a front perspective view of a mortarless retaining wall constructed of a plurality of multi-component segmented retaining wall (SRW) blocks according to some embodiments of the present invention.

FIG. 1 is a front perspective view of a mortarless retaining wall 10 constructed of a plurality of multi-component segmented retaining wall (SRW) blocks 12 according to some embodiments of the present invention. As illustrated, the wall 10 consists of a first course 14 of SRW blocks 12 and a second course 16 of SRW blocks 12 stacked over the first course 14. Any number of courses is within the scope of the present invention. The second course 16 is constructed with a setback 18 relative to the first course 14. As described further below, any level of setback, including no setback, is within the scope of the present invention. In addition, the second course 16 could even be set forward relative to the first course 14, either for the entire course or just intermittently within the second course. The front sides 20 of blocks 12 on the wall 10 are typically exposed as shown. The back sides 22 of blocks 12 on the wall 10, however, is typically hidden from view and is confronting soil (not shown) being retained in place by the wall 10. The soil, of course, creates pressure on the back side 22 of the wall 10 and its SRW blocks 12, tending to push the SRW blocks 12 forward.

Figure 2A:
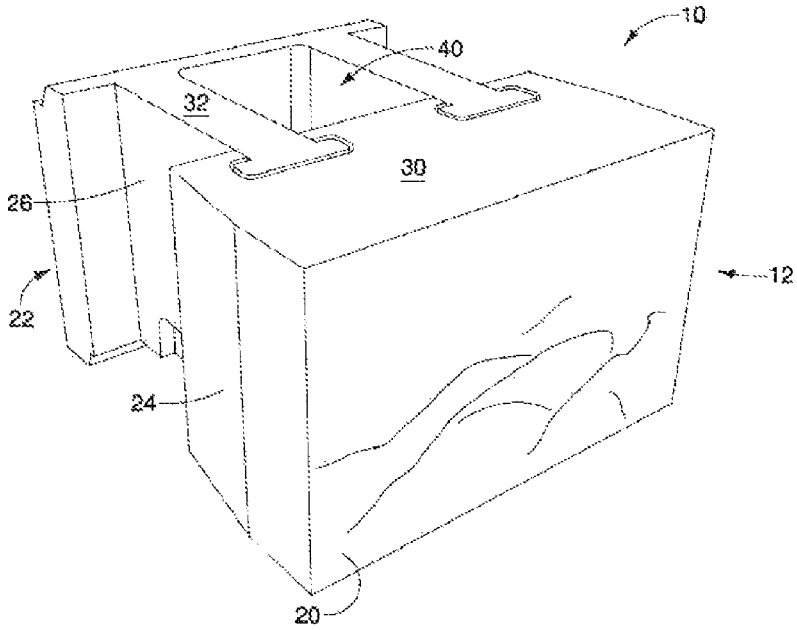
FIG. 2A is a front perspective view of a multi-component SRW block according to some embodiments of the present invention.
Figure 2B:
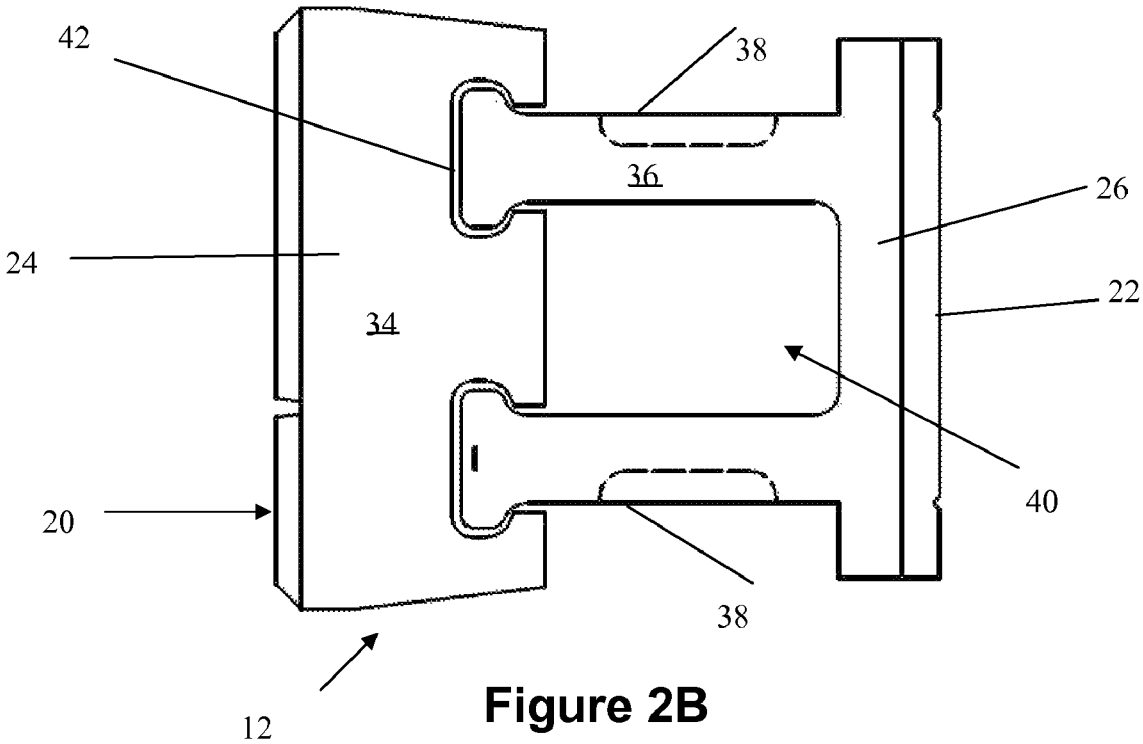
FIG. 2B is a bottom view of a multi-component SRW block according to some embodiments of the present invention.
Figure 3A:
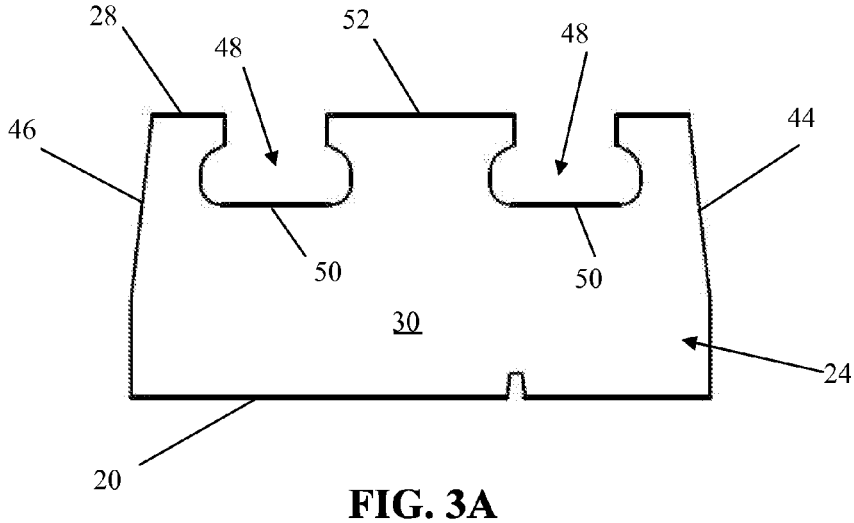
FIG. 3A is a top view of a face unit of a multi-component SRW block according to some embodiments of the present invention.
Figure 3B:
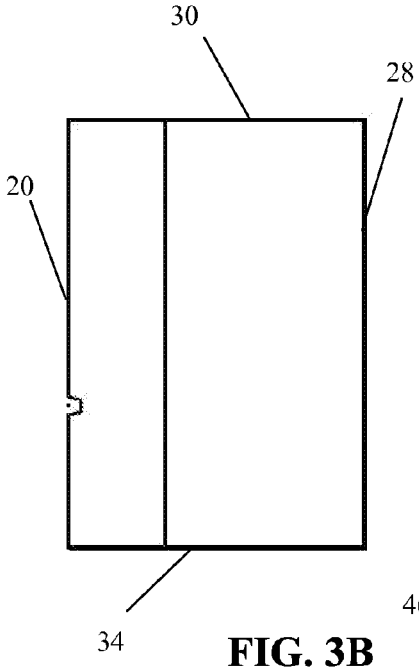
FIG. 3B is a side view of the face unit of FIG. 3A.
Figure 3C:
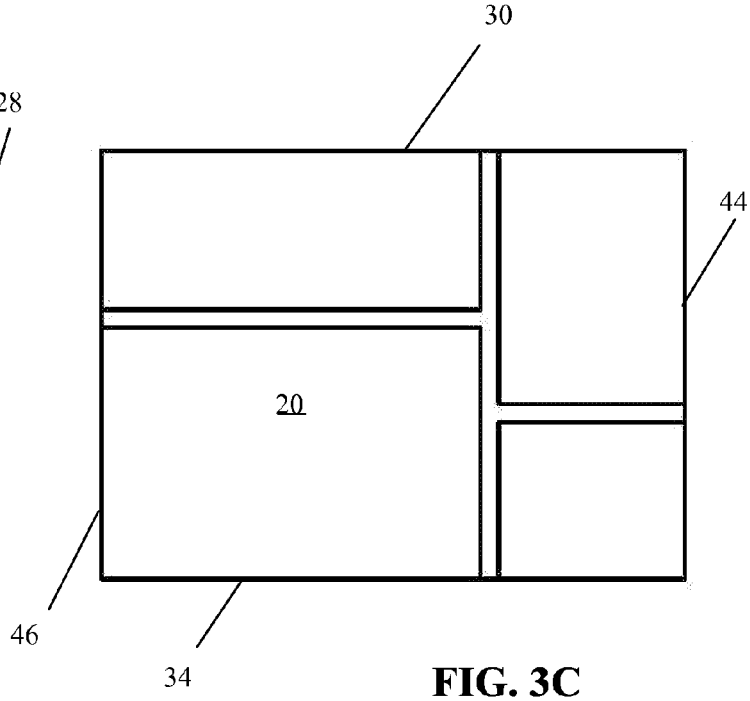
FIG. 3C is a front view of the face unit of FIG. 3A.

FIG. 2A is a front perspective view of a multi-component SRW block 12 according to some embodiments of the present invention. FIG. 2B is a bottom view of a multi-component SRW block 12 according to some embodiments of the present invention. As shown, the SRW block 12 is comprised of two components, a face unit 24 and an anchor unit 26, interlocked together via respective connector elements. The face unit 24 has a facing surface 20 that defines part of the exposed surface of the retaining wall. The face unit 24 also has two connector elements described further below. The anchor unit 26 has a rear surface 22 against which soil bears and is retained by the rear surface 22. The anchor unit 26 also has two connector elements of complementary size and shape to respective connector elements of the face unit. Several advantages are realized by forming SRW block 12 of two interlockable components. For instance, for those persons who move, stack, or otherwise handle SRW blocks from production to ultimate placement and wall assembly, it is much easier to lift, move, and accurately place a SRW block component than it is to lift, move, and accurately place an entire one-piece SRW block. Other advantages of the multi-component design are provided below.

The SRW blocks 12 in FIG. 1 are freestanding. That is, no mortar is required to form the wall. With reference again to FIGS. 2A and 2B, SRW block 12 has parallel load bearing surfaces on the top and bottom of the block. The upper load bearing surface is formed by the face unit upper surface 30 and the anchor unit upper surface 32. The lower load bearing surface is formed by the face unit lower surface 34 and the anchor unit lower surface 36. The load bearing surfaces are formed transversely to the front surface 20 and the back surface 22. SRW block 12 also has side walls 38 formed transversely to the top surfaces 30, 32 and the face surface 20. In the embodiment shown, the side walls 38 are formed by the anchor unit 26. In the embodiment shown, the side walls 38 extend the entire height of the SRW block, from the lower load bearing surface to the upper load bearing surface. In other embodiments, the side walls do not extend the entire distance between the upper and load bearing surfaces.

When the face unit 24 and the anchor unit 26 are interlocked, as shown in FIGS. 2A and 2B, the multi-component SRW 12 formed contains a hollow core 40. Hollow core 40 extends vertically through the SRW block from the lower bearing surface to the upper bearing surface and is bounded by inner walls of the anchor unit 26 and the face unit 24. Hollow core 40 provides several advantages. First, the central hollow core 40 also reduces the quantity of material required for production of the SRW block, which is a cost reduction feature. The hollow core 40 also reduces the weight per square foot of the SRW block without sacrificing the load bearing strength. This feature lightens the load for shipping as well as for those persons who move, stack, or otherwise handle the individual blocks from production to ultimate placement and wall assembly. The hollow core 40 of each SRW block 12 in the wall may also be filled with a rock or earthen fill to stabilize and reinforce the wall 10 against the soil pressure. Such fill may include a clean granular backfill, such as clean crushed rock or binder rock, or on-site soils such as, for example, black earth, typically containing quantities of clay and salt. As noted below, the relative positions of the face unit connectors and the anchor unit connectors form an interlock that is stabilized via the addition of fill in the hollow core 40. That is, the connectors permit relative vertical movement between the face unit 24 and the anchor unit 26 but resist and generally prevent relative longitudinal (front to back) movement and lateral (side to side) movement between the face unit 24 and the anchor unit 26. The fill adds pressure internal to SRW block 12 within the hollow core 40 to further restrict all relative movement between the face unit 24 and the anchor unit 26.

In addition, as seen in FIG. 2B, there is a small gap 42 in the interface between the connectors providing a loose connection between the face unit 24 and anchor unit 26. The small gap 42 provides for easier assembly of the anchor unit 26 and face unit 24 into a SRW block 12 and allows for limited relative movement (play) between the anchor unit and the face unit without disconnecting the interlock. With the "play" as described above, the SRW block 12 conforms better to lower courses or the terrain.

FIGS. 3-7 show different embodiments of a face unit of a SRW block. FIG. 3A is a top view of a face unit 24 of a multi-component SRW block according to some embodiments of the present invention. FIG. 3B is a side view of the face unit 24 of FIG. 3A. FIG. 3C is a front view of the face unit 24 of FIG. 3A. With reference to FIGS. 3A-3C, the face unit 24 has opposing parallel front 20 and back 28 faces, opposing parallel top 30 and bottom 34 surfaces, and opposing right 44 and left 46 sides. The top 30 and bottom 34 surfaces are generally transverse to the front 20 and back faces 28 and are substantially planar. The top 30 and bottom 34 surfaces function as load bearing surfaces, where the top surface 30 mates with and supports the bottom surface 34 of a super-imposed stacked block. Since the top 30 and bottom 34 surfaces are substantially flat, the face units 24 may be stacked with or without a setback. The front surface 20 provides a facing surface that defines part of the exposed surface of the retaining wall. The front surface 20 may have a pattern molded or formed thereon, such as the pattern shown in FIG. 3C. The back surface 28 is generally planar and has two connectors 48 for interconnection with the connectors of an anchor unit. In the embodiment shown, the connectors 48 are formed as recesses or pockets in the back surface 28. The pockets are shaped as elongated keyways that run the entire height of the face unit, from the bottom surface 34 to the top surface 30. It is understood, however, that the keyway need not extend the entire height of the face unit 24. The keyways are shaped to permit relative vertical movement between the face unit 24 and the anchor unit, but to generally restrict movement in other directions. The pockets could be of other shapes long as they remain of complementary size and shape to the anchor unit connectors. The generally flat surface 50 of the pocket leaves more mass intact in the face unit and adds strength to the face unit 24. That is, the pocket extends inward less than half the depth of the face unit 24 due, in part, to the flat surface 50 formed by the pocket. Between the connectors 48 is a central portion 52 of the back surface. The central portion 52 forms one of the walls of the hollow core 40 (see FIG. 2B). The face unit is about one foot wide, almost 6 inches deep and about 8 inches high. The central portion 52 of the back wall 28 is about 4 inches wide, which corresponds to the width of the hollow core. In the embodiment shown in FIGS. 3A-3C, the side walls 44, 46 of face unit 24 taper inwardly rearwardly. The taper permits the face units to be placed such that the front surfaces 20 are angled relative to each other. For instance, if it is desired that the retaining wall be constructed to form a convex curve (from the perspective of the front), the tapered sides 44, 46 provide adequate relief to all the face units to be angled relative to each other. In other embodiments, as discussed below, one or both sides of the face unit are instead transverse to the front surface 20.

Figure 4A:
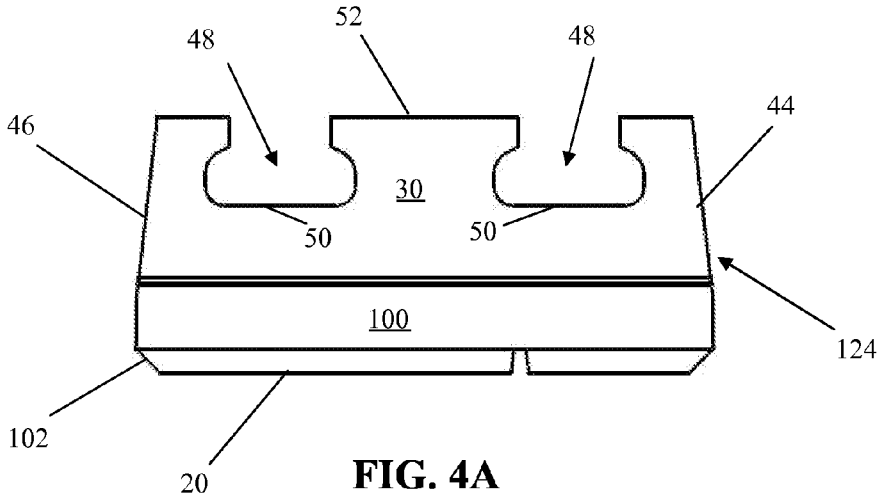
FIG. 4A is a top view of a face unit of a multi-component SRW block according to some alternate embodiments of the present invention.
Figure 4B:
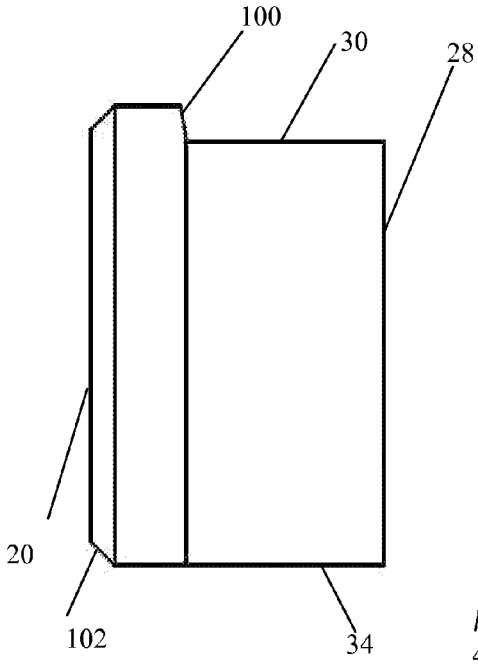
FIG. 4B is a side view of the face unit of FIG. 4A.
Figure 4C:
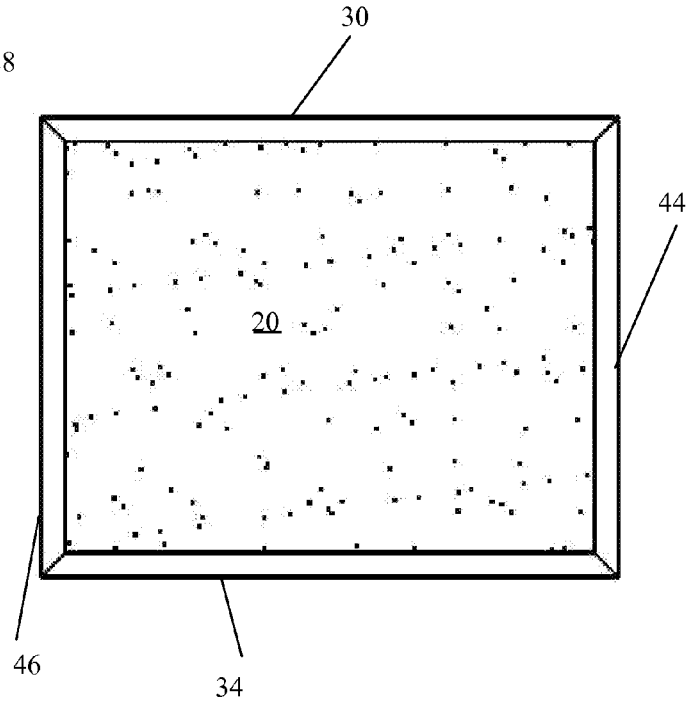
FIG. 4C is a front view of the face unit of FIG. 4A.

FIG. 4A is a top view of a face unit 124 of a multi-component SRW block according to some alternate embodiments of the present invention. FIG. 4B is a side view of the face unit 124 of FIG. 4A. FIG. 4C is a front view of the face unit 124 of FIG. 4A. The face unit 124 of FIGS. 4A-4C is similar to that shown in FIGS. 3A-3C, except as described hereinafter. Face units may be manufactured with one or more alignment elements, including a lip, notch, pin recess, and a slot. In FIGS. 4A-4C, face unit 124 includes an alignment element formed as a lip 100 extending laterally across the width of the otherwise flat top surface 30 of the face unit 124 at the front of the top surface 30. The bottom surface 34 of the face unit 124 remains flat without a lip or a notch. Accordingly, the depth or thickness of the upper lip 100 dictates the minimum setback created by stacking subsequent courses of multi-component SRW blocks with face units 124 on top of each other. Setback is generally considered to be the distance in which one course of a wall extends beyond the front of the next highest course of the same wall. The face unit of FIGS. 4A-4C also shows a chamfer 102 leading to a front surface 20 formed with a texture.

Figure 5A:
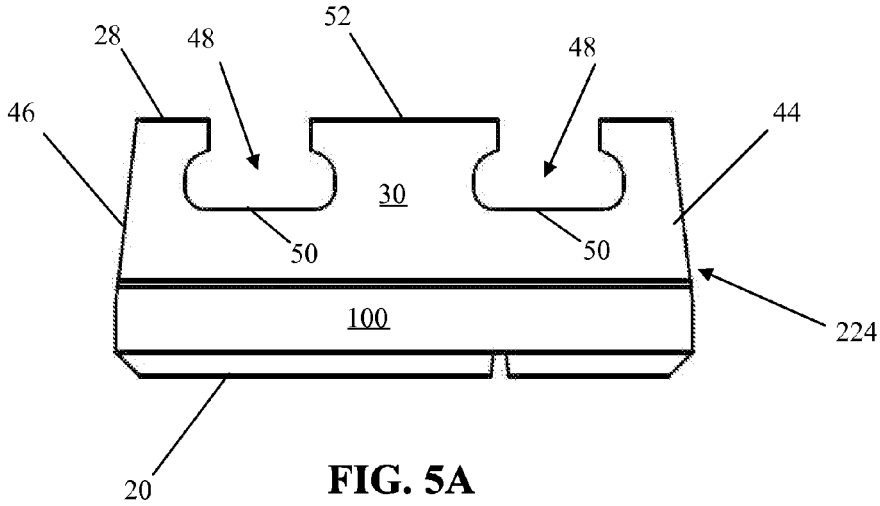
FIG. 5A is a top view of a face unit of a multi-component SRW block according to some alternate embodiments of the present invention.
Figure 5B:
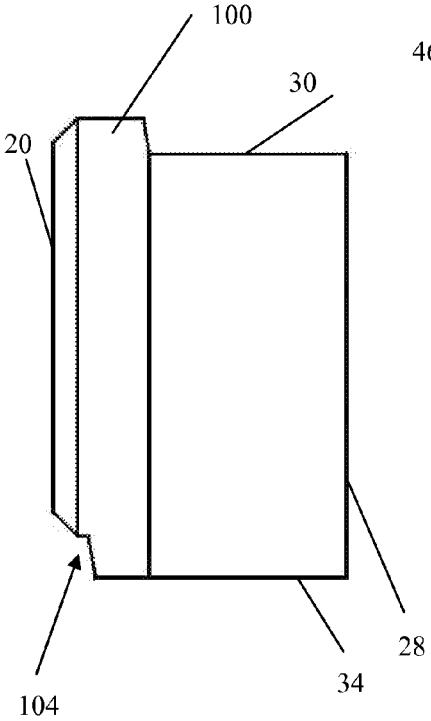
FIG. 5B is a side view of the face unit of FIG. 5A.
Figure 5C:
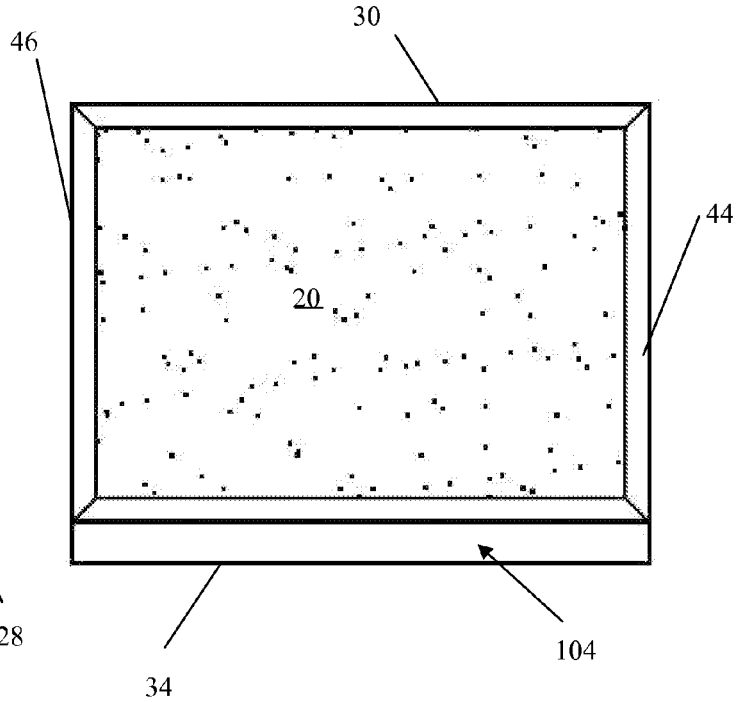
FIG. 5C is a front view of the face unit of FIG. 5A.

FIG. 5A is a top view of a face unit 224 of a multi-component SRW block according to some alternate embodiments of the present invention. FIG. 5B is a side view of the face unit 224 of FIG. 5A. FIG. 5C is a front view of the face unit 224 of FIG. 5A. The face unit 224 of FIGS. 5A-5C is similar to that shown in FIGS. 4A-4C, except as described hereinafter. In FIGS. 5A-5C, face unit 224 includes two alignment elements, a lip 100 similar to the lip in FIGS. 4A-4C and a notch 104 extending laterally across the width of the otherwise flat bottom surface 34 of the face unit 224 at the front of the bottom surface 34. Accordingly, the setback depth of each course of blocks is based on the difference in depths between the laterally extending lip 100 and the notch 104 of face unit 224. In some embodiments, part or all of one course may also be set forward relative to an underlying course. In some embodiments, the height of the lip 100 remains less than or equal to the height of the notch 104 in order for the load bearing surfaces of the stacked blocks to properly seat against each other.

Figure 6A:
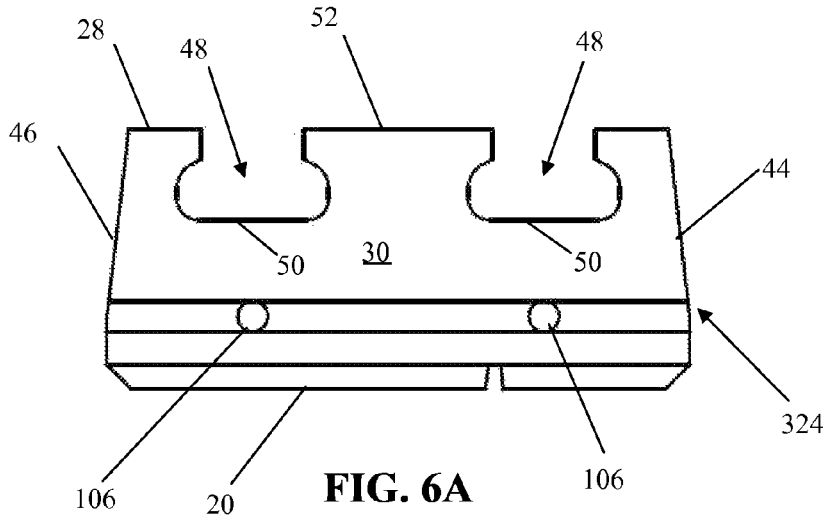
FIG. 6A is a top view of a face unit of a multi-component SRW block according to some alternate embodiments of the present invention.
Figure 6B:
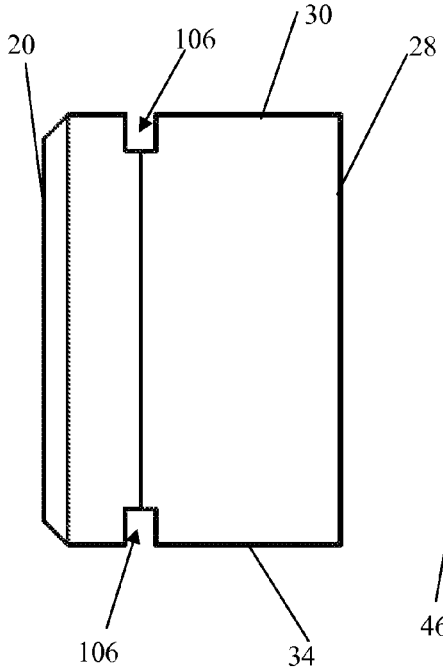
FIG. 6B is a side view of the face unit of FIG. 6A.
Figure 6C:
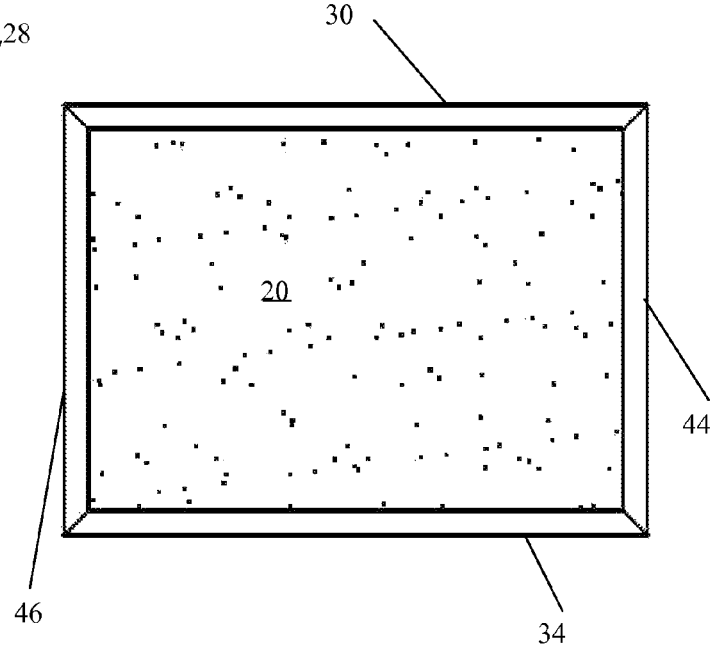
FIG. 6C is a front view of the face unit of FIG. 6A.

FIG. 6A is a top view of a face unit 324 of a multi-component SRW block according to some alternate embodiments of the present invention. FIG. 6B is a side view of the face unit 324 of FIG. 6A. FIG. 6C is a front view of the face unit 324 of FIG. 6A. The face unit 324 of FIGS. 6A-6C is similar to that shown in FIGS. 3A-3C, except as described hereinafter. In FIGS. 6A-6C, face unit 324 includes an alignment element formed as pin recesses or apertures 106. In some embodiments, such apertures 106 extend vertically through the entire height of face unit 106. The face unit 324 may be positioned such that one or more apertures 106 of one face unit 324 may be aligned the corresponding one or more apertures 106 of subjacent and superimposed face units. The elongated vertical passages created by such alignment may be filled with dirt or other materials or receive vertical tie elements such as re-bars. Accordingly, apertures may be used to align and tie stacked blocks to one another. In other embodiments, apertures 106 do not extend through the entire height of the face unit. Instead, apertures 106 extend part way from both the top surface 30 and the bottom surface 34 of the face unit. In such case, apertures may be used to align and tie stacked blocks to one another via the use of short pins (not shown).

Figure 7:
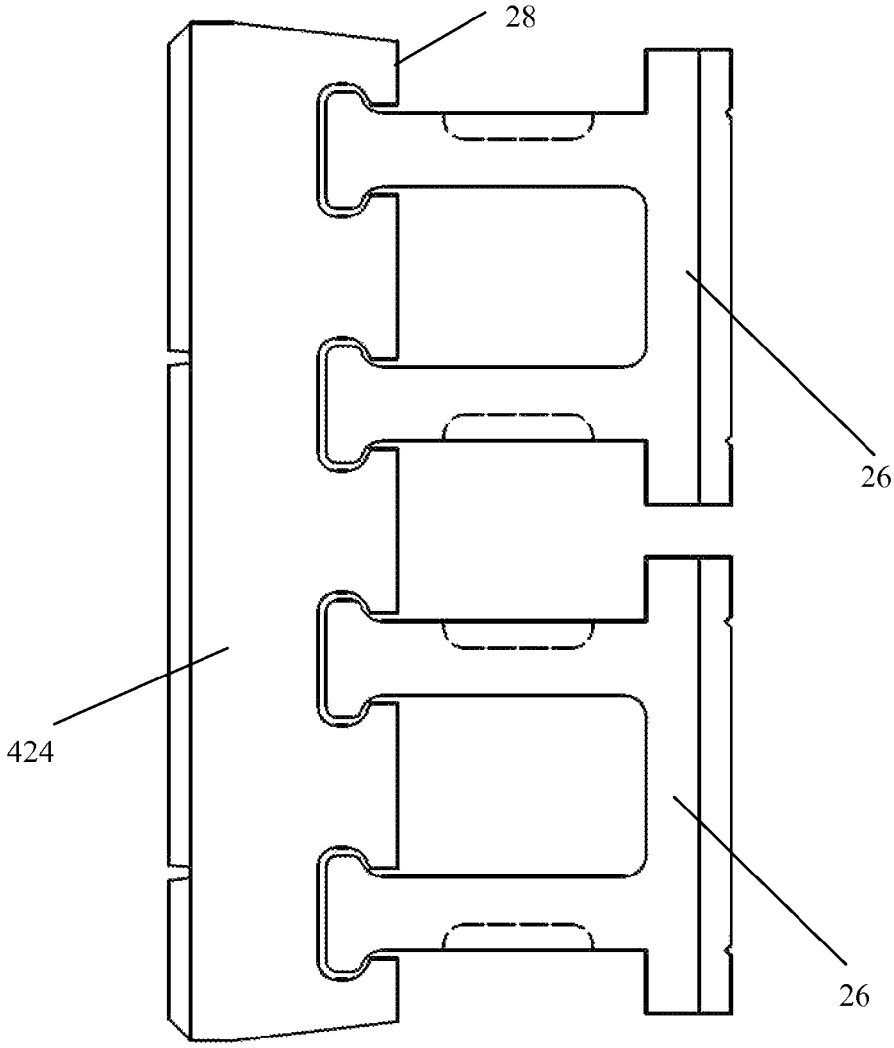
FIG. 7 is a top view of a multi-component SRW block according to some alternate embodiments of the present invention.

FIG. 7 is a top view of a multi-component SRW block according to some alternate embodiments of the present invention. The face unit 424 of FIG. 7 is similar to that shown in FIGS. 3A-3C, except as described hereinafter. In this embodiment, a wide face unit 424 is used along with two anchor units 26 to form the SRW block. The wide face unit 424 is about double the width of the face units shown, for instance, in FIGS. 3 and 4. The back surface 22 is generally planar and has four connectors for interconnection with the connectors of two anchor units 26. In the embodiment shown, the connectors of face unit 424 are formed as recesses or pockets in the back surface 22.

Figure 8A:
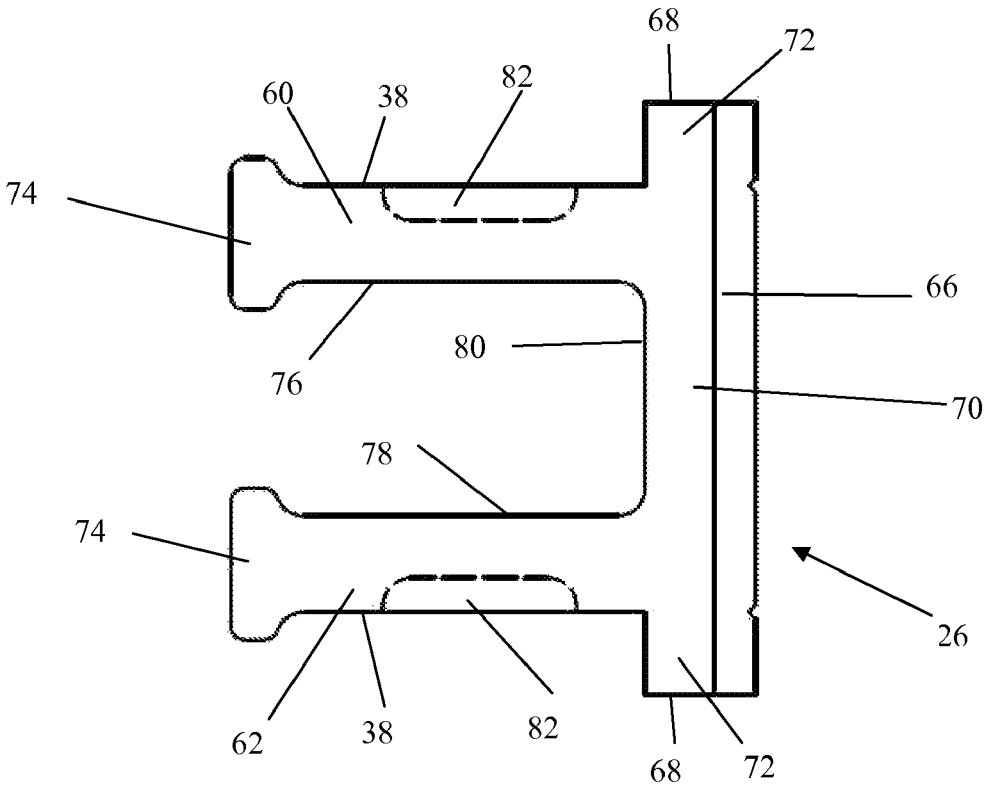
FIG. 8A is a bottom view of an anchor unit of a multi-component SRW block according to some embodiments of the present invention.
Figure 8B:
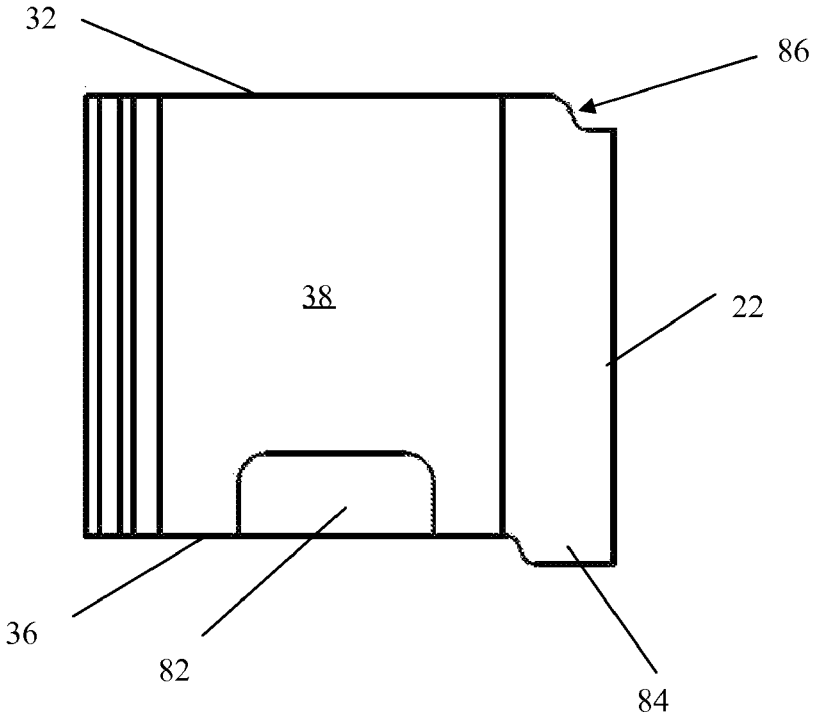
FIG. 8B is a side view of the anchor unit of FIG. 8A.
Figure 8C:
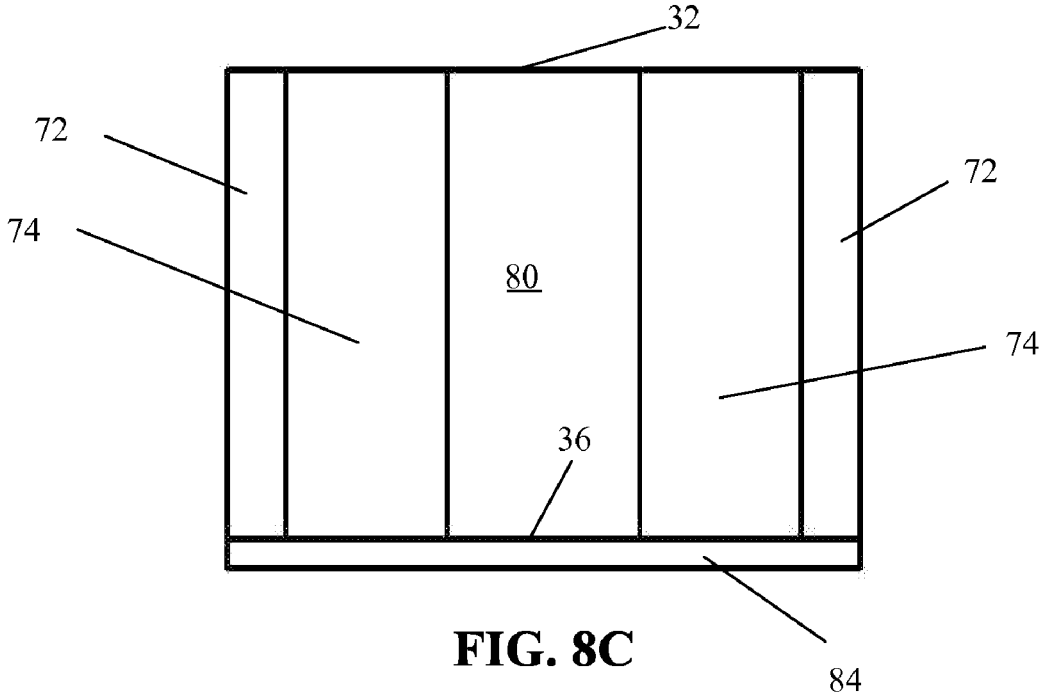
FIG. 8C is a front view of the anchor unit of FIG. 8A.
Figure 8D:
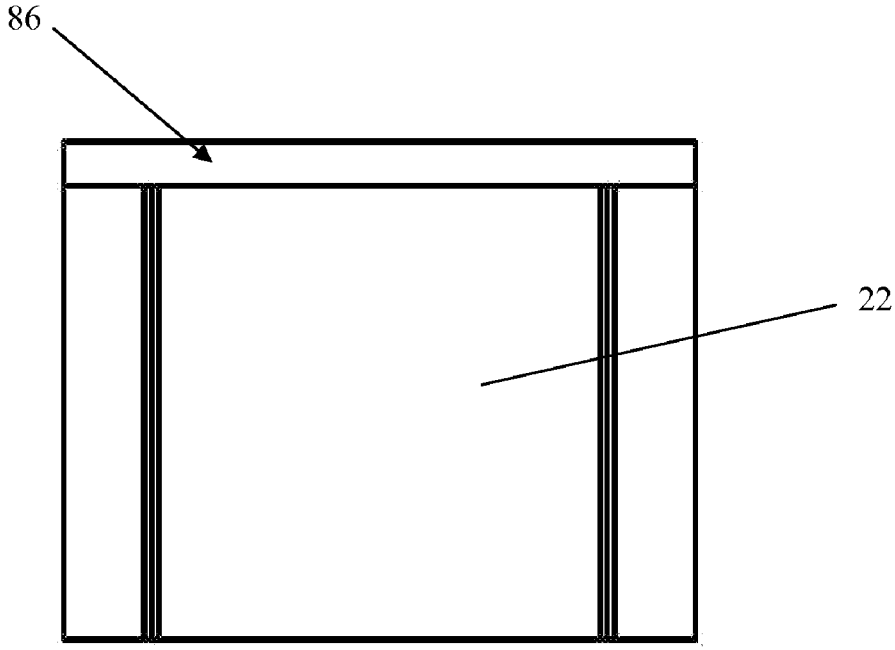
FIG. 8D is a rear view of the anchor unit of FIG. 8A.

FIG. 8A is a bottom view of an anchor unit 26 of a multi-component SRW block according to some embodiments of the present invention. FIG. 8B is a side view of the anchor unit 26 of FIG. 8A. FIG. 8C is a front view of the anchor unit 26 of FIG. 8A. FIG. 8D is a rear view of the anchor unit 26 of FIG. 8A. From the perspective of the top view in FIG. 8A, anchor unit 26 has a generally U-shape having a first leg 60 and second leg 62 interconnected by a back segment 66. The back segment 66 has a back surface 22 that forms the back surface of the SRW block and confronts soil being retained by the retaining wall. The first leg 60 and second leg 62 are inset from the side ends 68 of the back segment 66, and are therefore connected via a central portion 70 of the back segment 66. Accordingly, the back segment 66 also includes outer flanges 72 that extend outward of the central portion 70. The width of the back segment 66 is slightly narrower than that of the widest portion of the face unit such that a retaining wall constructed of such anchor units and face units may form a convex curve (from the perspective of the front). The relatively narrower back segments 66 provide adequate relief to allow the face units to be angled relative to each other without interference from the anchor units 26. In certain embodiments, the back segment 66 extends approximately the same width as the back face of the face unit. In alternate embodiments, the outer flanges 72 are eliminated and the back segment 66 only includes the central portion 70. In the embodiment shown, the first leg 60 and second leg 62 terminate in respective connector elements 74. The connector elements 74 are shaped as hammer-head keys that extends the entire height of the anchor unit 26. It is understood, however, that the keys need not extend the entire height of the anchor unit 26. The connector elements are of complementary shapes to the face unit connector elements for interconnection therewith. The two connector elements 74 are of the same shape and/or size. It is understood, though, that connector elements 74 may be of different shapes and/or sizes as long as the connector elements of the face unit are constructed of complementary shapes and/or sizes for interconnection therewith. For instance, the connector shape could be circular instead of a flat hammer-head.

First leg 60 and second leg 62 of the anchor unit 26 form outer side walls 38 of the SRW block. In the embodiment shown, the side walls 38 extend the entire height of the anchor unit 26, from a lower load bearing surface 36 of the anchor unit to an upper load bearing surface 32 of the anchor unit. The load bearing surfaces 32, 36 are substantially planar, parallel to each other, and each formed transversely to the back segment. The upper surface 32 mates with and supports the lower surface 36 of a super-imposed stacked SRW block. As noted above, when a face unit and an anchor unit are interlocked, as shown in FIGS. 2A and 2B, the multi-component SRW formed contains a hollow core 40. The hollow core is formed, in part, by an inner wall 76 of the first leg, an inner wall 78 of the second leg 62, and the front wall of the back segment 80. In some anchor unit embodiments, the first leg 60 and the second leg 62 include hand-holds 82 useful when lifting the anchor units 26. In the embodiment shown, hand-holds 82 are formed as recesses on the bottom of the outside walls 38. The hand-holds 82 may also be formed as protrusions and they may be located at convenient locations other than the bottom of the outside walls (e.g., midway up or at the top of the outside walls).

Figure 9:
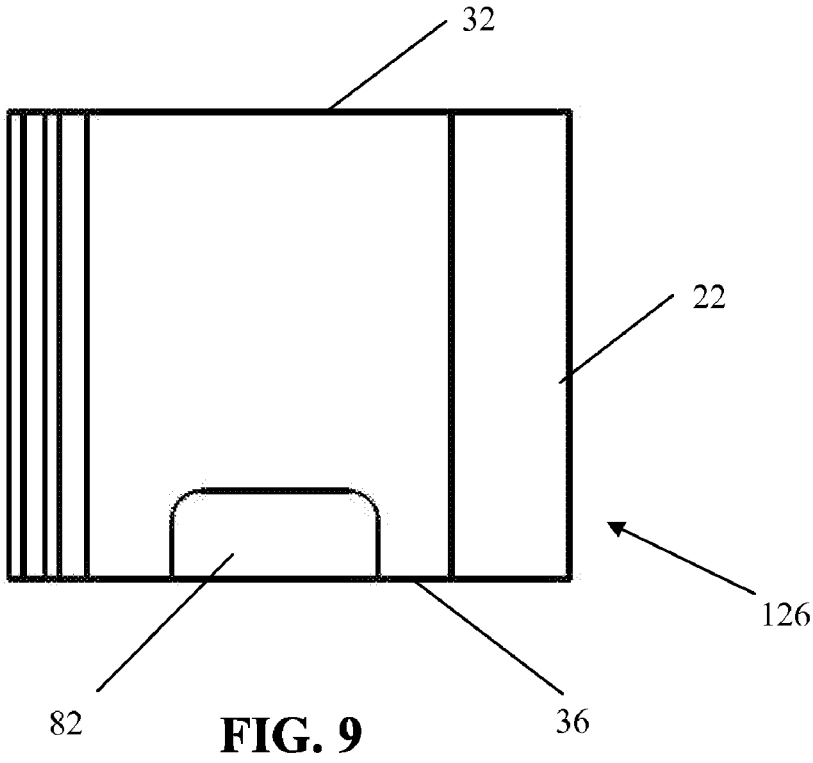
FIG. 9 is a side view of an anchor unit of a multi-component SRW block according to some alternate embodiments of the present invention.

Similar to face units, anchor units may also be manufactured with one or more alignment elements, including a lip, notch, pin recess, and a slot. In the embodiment shown in FIGS. 8A-8D, anchor unit 26 includes two alignment elements. One alignment element is formed as a lip 84 extending laterally across the width of the otherwise flat bottom surface of the face unit 24 at the back of the back segment 66. The second alignment element is a notch 86 extending laterally across the width of the otherwise flat top surface 32 of the anchor unit 26 at the back of the top surface 32. Accordingly, the setback depth of each course of blocks is based on the difference in depths between the laterally extending lip 84 and the notch 86 of anchor unit 26. FIG. 9 is a side view of an anchor unit 126 of a multi-component SRW block according to some alternate embodiments of the present invention. As shown in this alternate embodiment, anchor units may be manufactured without any alignment element. In such a case, any setback is based on a lip or notch or other element on the corresponding face unit.

Figure 10:
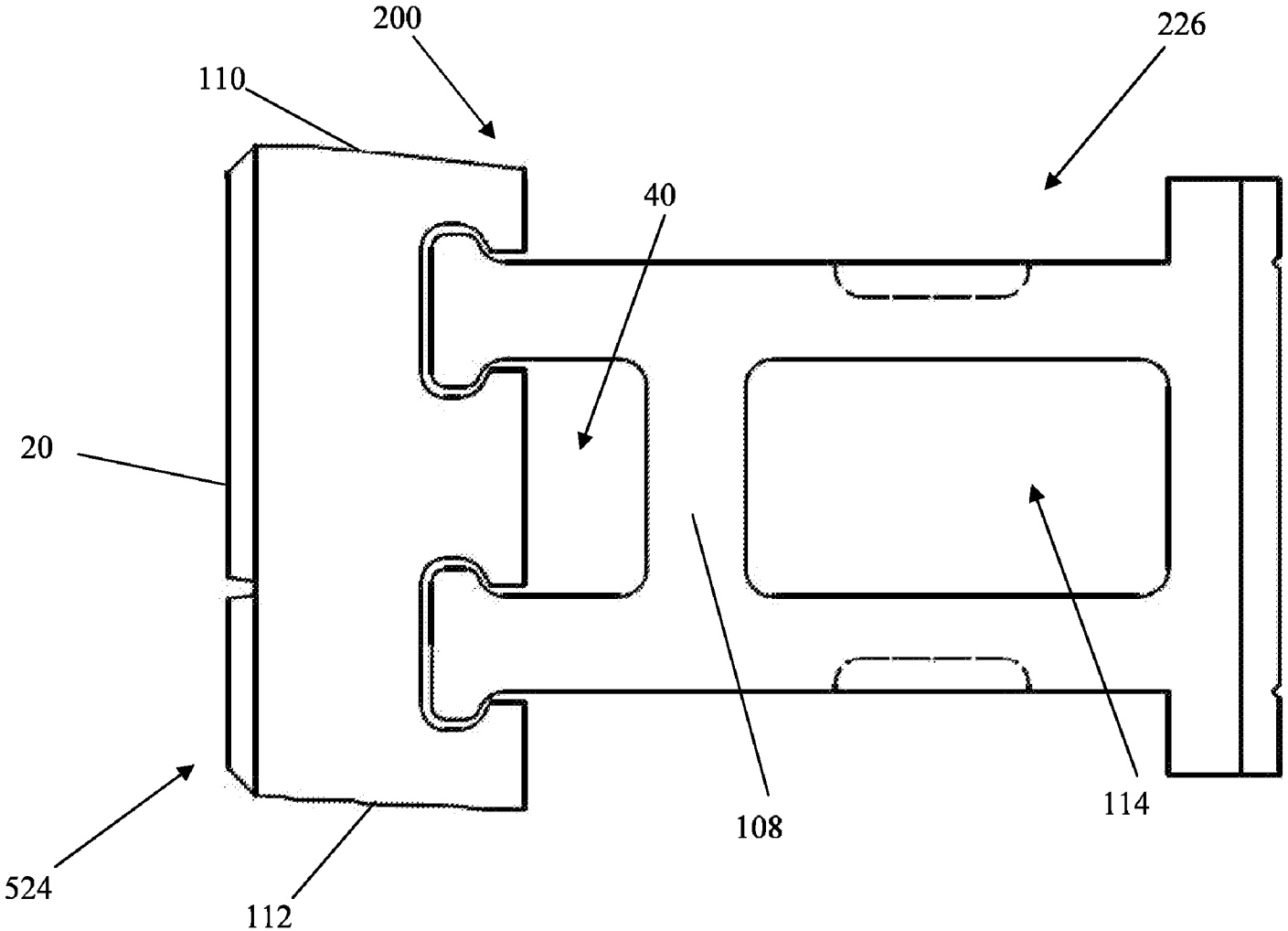
FIG. 10 is a top view of a multi-component SRW block according to some alternate embodiments of the present invention.

FIG. 10 is a top view of a multi-component SRW block 200 according to some alternate embodiments of the present invention. The anchor unit 226 of FIG. 10 is similar to that shown in FIGS. 8A-8D, except as described hereinafter. Anchor unit 226 is deeper than anchor unit in FIGS. 8A-8D. Since deeper anchor units have greater mass and greater load bearing surfaces, they increase the stability of the resulting retaining wall. Deeper anchors, such as anchor unit 226, may therefore be appropriate for taller retaining walls. That is, instead of, or in addition to other types of anchoring devices, such as geogrid, a deeper anchor may be used to help stabilize taller retaining walls. In order to strengthen the deeper anchor 226 an additional cross-member 108 beyond the cross-member formed by the back segment 266 is included in the manufacture of the deeper anchor 226. Although two cross-members are shown on deeper anchor 226, additional cross-members could be used. The face unit of FIG. 10 is similar to that shown in FIGS. 3A-3C, except as described hereinafter. One 110 of the side walls of face unit 524 tapers inwardly rearwardly, similar to the taper of the sidewalls in FIGS. 3A-3C. However, the opposite sidewall 112 of face unit 524 is approximately transverse to the front surface 20 of face unit 524. In addition, the opposite sidewall 112 may be finished to match the front surface 20. Accordingly, face unit 524 may be used as part of the SRW block that forms the end block or last block in a course of blocks of a retaining wall. The taper on one 110 of the side walls permits this same face unit 524 to be placed such that the front surfaces 20 are angled relative to each other. Face unit 524 and anchor unit 226 form a hollow core 40 when interlocked via respective connector elements. Anchor 226 also forms a second hollow core 114 between its cross-members. Hollow core 114 may be filled similar to hollow core 40 as noted above.

Figure 11:
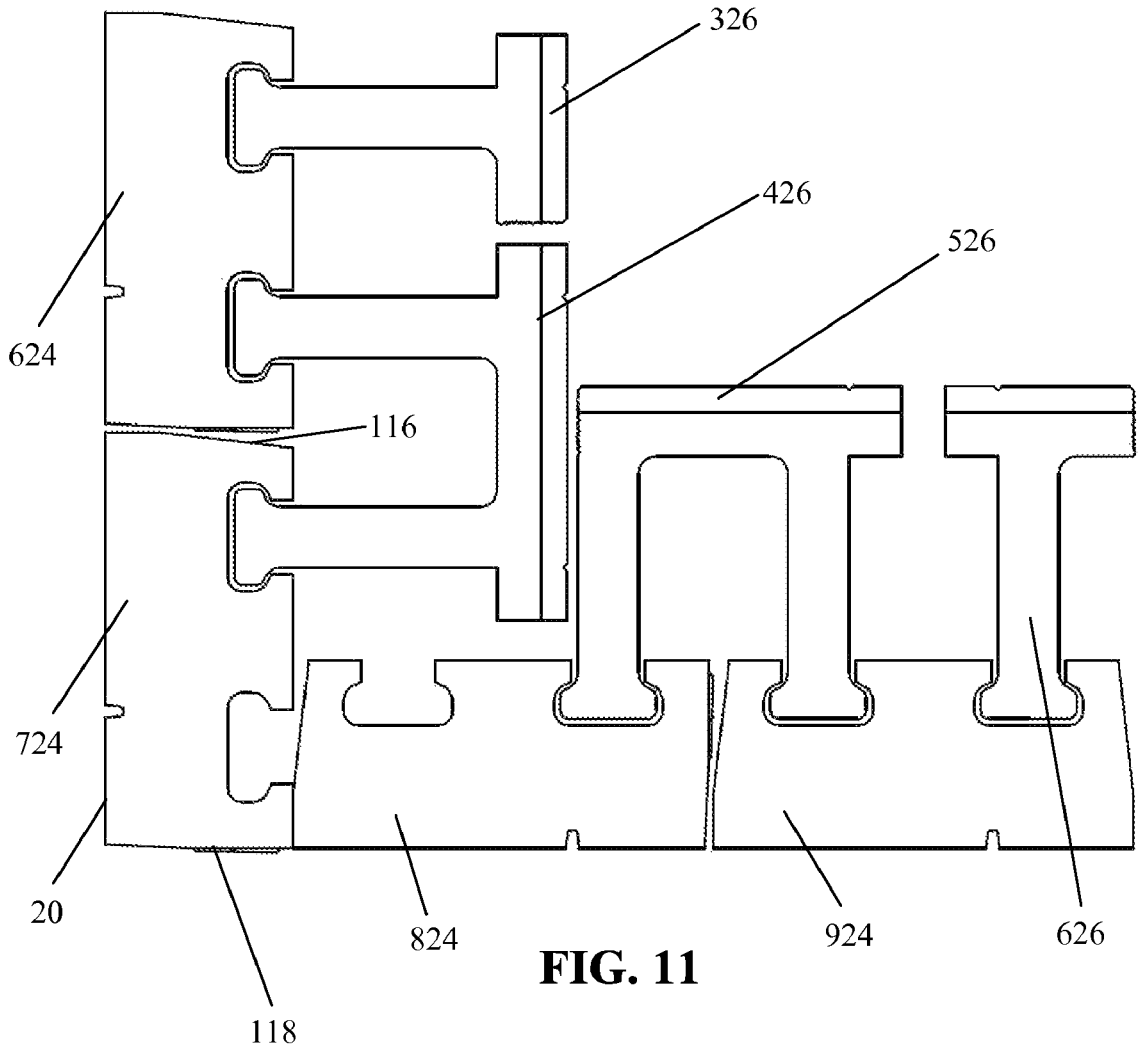
FIG. 11 is a top view of a corner assembly of multi-component SRW blocks according to some alternate embodiments of the present invention.

FIG. 11 is a top view of a corner assembly of multi-component SRW blocks according to some alternate embodiments of the present invention. FIG. 11 represents the corner portion of one course of SRW blocks that form a retaining wall. The corner assembly is formed by face units 624, 724, 824, and 924 that are connected to anchor units 326, 426, 526, and 626, as shown. The face units are similar to those described herein with reference to FIG. 10. For instance, one 116 of the side walls of face unit 724 tapers inwardly rearwardly, similar to the taper of the sidewalls in FIGS. 3A-3C, which allows for the construction of a curved wall. However, the opposite sidewall 118 of face unit 724 is approximately transverse to the front surface 20 of face unit 724. In addition, the opposite sidewall 118 may be finished to match the front surface 20. Accordingly, face unit 724, as shown in FIG. 11, is used as part of the SRW block that forms the corner block or last block in a course of blocks of a retaining wall. Any of face units 624, 724, 824, and 924 may be used as corner or end blocks. Anchor units 326, 426, 526, and 626 are similar to those shown in FIGS. 8A-8D. However, anchor units 326 and 626 are merely a single anchor unit that has been split into two. Additionally, one flange portion of anchor unit 526 has been removed so that it fits into the corner configuration. The assembly of anchor units 426 and 526 to respective face units also demonstrates that the center to center distance of the connectors of anchor units 426 and 526 is equal to the center to center distance of the connectors of face units 624, 724, 824, and 924. By manufacturing the face units and anchor units with such symmetry, one anchor unit may connect between two adjacent face units as shown in FIG. 11.

Figure 12:
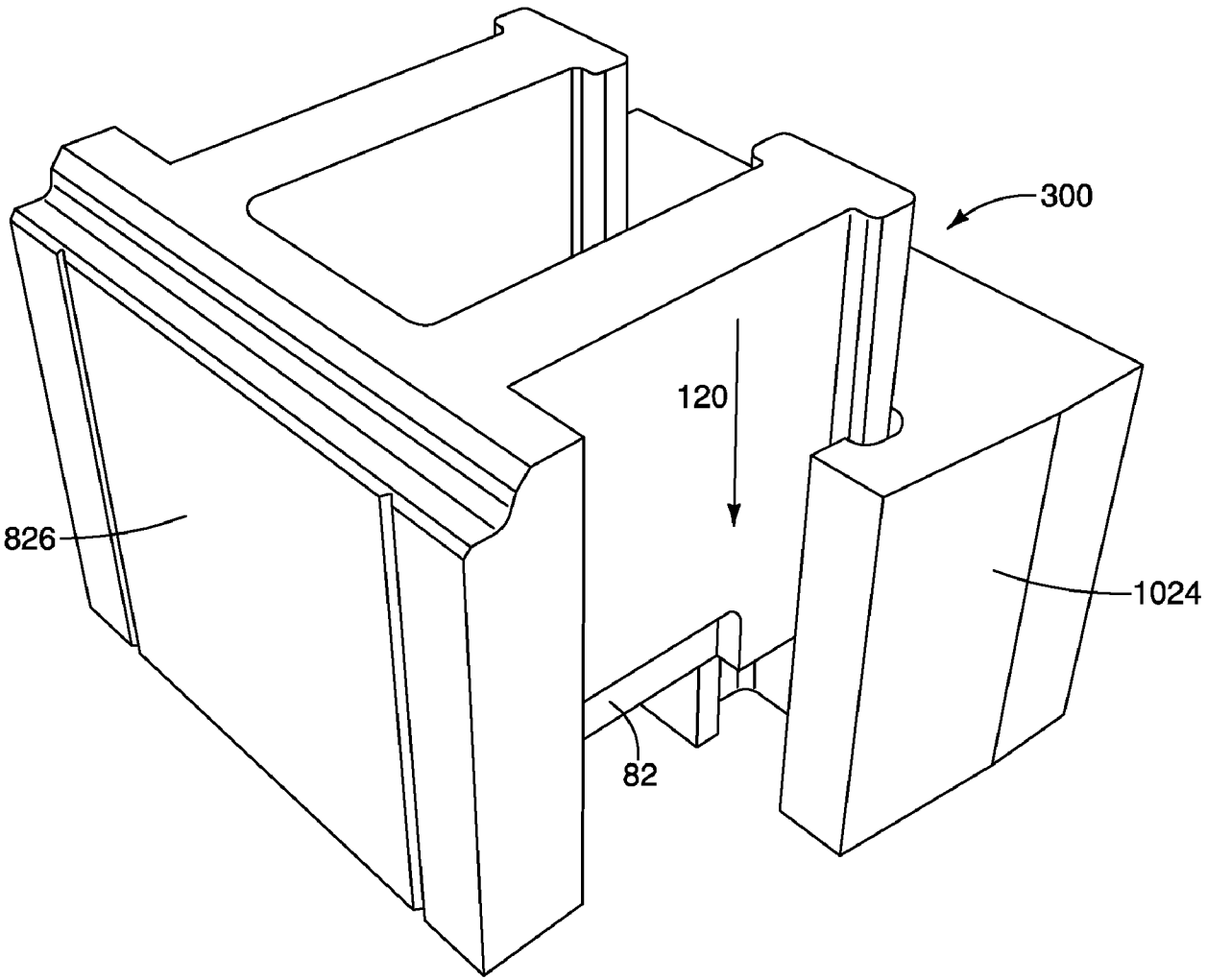
FIG. 12 is a perspective view of a method of joining an anchor unit to a face unit to form a multi-component SRW block according to some embodiments of the present invention.

FIG. 12 is a perspective view of a method of joining an anchor unit to a face unit to form a multi-component SRW block 300 according to some embodiments of the present invention. The SRW block 300 is comprised of face unit 1024 with connectors and anchor unit 826 with connectors. As shown, the face unit 1024 is placed into the desired location and orientation. The connectors of anchor unit 826 are then slid down the channels of the face unit connectors in the direction indicated by arrow 120 until the top surfaces and the bottom surfaces of the anchor unit 826 and face unit 1024 are flush. In other embodiments, the anchor unit 826 is placed into position first, followed by the face unit. Since there is a small gap 42 (FIG. 2B) between the connectors, it is relatively easy to slide anchor unit 826 into the face unit 1024. In addition, the gap 42 permits one or both of the block components to be moved slightly after assembly in order to find a more stable position above the subjacent course of SRW blocks onto which the anchor unit 826 and face unit 1024 are placed. The gap may later be filled with a rock or earthen fill to reduce or eliminate the loose fit between the anchor unit and face unit. Such fill may occur simultaneously with the filling of the hollow core 40 of the SRW blocks.

Figure 13:
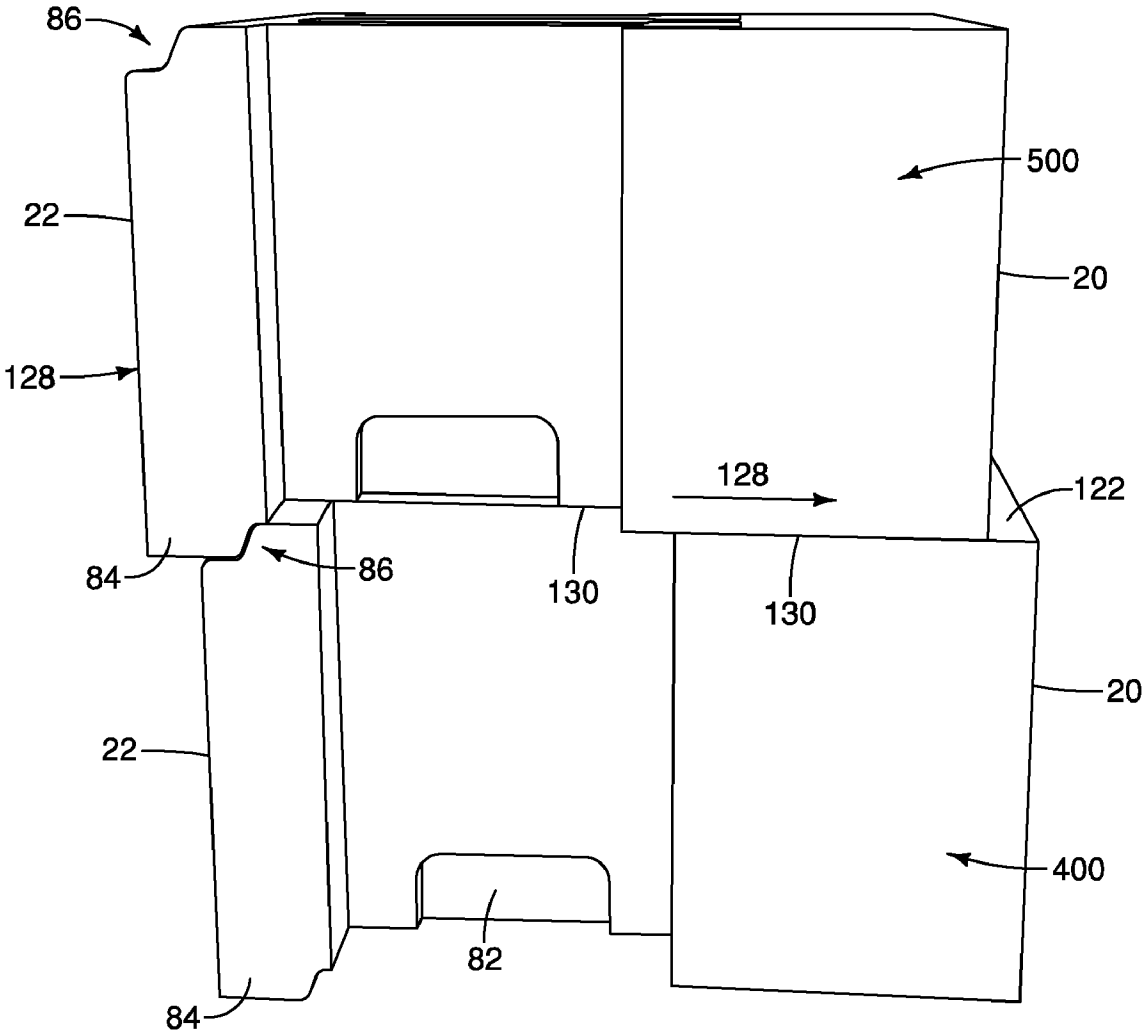
FIG. 13 is a side view of two of multi-component SRW blocks stacked atop each other.

FIG. 13 is a side view of a plurality of multi-component SRW blocks, as described herein, stacked atop each other to form a wall (or at least a portion of a wall). Block 400 is in the first course of blocks and block 500 is in the second course of blocks. Of course, any number of courses is within the scope of the present invention. Block 500 is assembled with a setback 122 relative to block 400. As described further below, any level of setback, including no setback, is within the scope of the present invention. The front surfaces 20 of blocks 400, 500 are typically exposed. The back sides 22 of blocks 400, 500, however, are typically hidden from view and confront soil (not shown) being retained in place by the wall. The soil, of course, creates pressure on the back side 22 of SRW blocks as indicated by arrows 128, tending to push the SRW blocks 400, 500 forward. One or more features of the multi-component SRW blocks adds stabilization to the wall. For instance, as noted above, the anchor unit and face unit each have upper and lower load bearing surfaces for mating with the lower load bearing surfaces of super-imposed stacked block. The load bearing surfaces may be generally planar. As shown by the interface 130 between blocks 400, 500, since the upper load bearing surface of block 400 and the lower load bearing surface of block 500 are generally planar, the surface area at the interface 130 is increased in order to provide a sufficient coefficient of static friction to resist the shear forces 128 applied by the soil that might otherwise cause block 500 to slide forward along the upper load bearing surface of block 400. Such planar surfaces add stabilization to the wall. In addition, as shown in FIG. 13, blocks 400, 500 include a lip 84 and a notch 86. As described above with reference to FIGS. 8A-8D, lip 84 extends laterally under the anchor units and at the rear thereof. Notch 86 extends laterally extends laterally over the anchor units and at the rear thereof. As noted above, the confrontation of the lip 84 on block 500 with the notch 86 on block 400 creates the setback 122. In addition, the lip and notch further stabilize the wall. The same confrontation of the lip 84 on block 500 with the notch 86 on block 400 resists the shear forces 128 applied by the soil that might otherwise cause block 500 to slide forward along the upper load bearing surface of block 400.

Face units and anchor units may be manufactured using many different methods, including wetcast, drycast, or an extrusion. For instance, the face unit or the anchor unit can be made through a process similar to that taught in Gravier, U.S. Pat. No. 5,484,236, the disclosure of which is incorporated herein by reference. An upwardly open mold box having walls defining one or more of the exterior surfaces of the block components is positioned on a conveyor belt. A removable top mold portion is configured to match other surfaces of the block component. A zero slump concrete slurry is poured into the mold and the top mold portion is inserted, with care being taken to distribute the slurry throughout the interior of the mold, following which the top mold portion is removed, as are the front, rear and side walls of the mold box, and the block components are allowed to fully cure. This reference to "top" may in fact be the bottom or other surface as the blocks are ultimately oriented. The same applies to references to bottom and side surfaces. In some embodiments in accordance with the invention, core bars of various sizes may be used to create anchor units and face units. For instance, core bars may be used to create the alignment elements discussed herein, including lips, notches, pin recesses, and slots. Core pulling techniques such as disclosed in U.S. Pat. No. 5,484,236, entitled "METHOD OF FORMING CONCRETE RETAINING WALL BLOCK", assigned to the same assignee as the present invention, may be employed in production.

Since the block components are smaller than fully assembled blocks, multiple components may be formed at a time in a single mold box. For instance, it is known in the form blocks in pairs, whereupon a composite block is split to form a pair of substantially identical blocks to economize the production of the blocks. Further, splitting a composite block allows the formation of an irregular and aesthetically pleasant textured front surface for each of the blocks defined. Thus, splitting a molded composite block has the dual function of facilitating an economical method of producing multiple blocks from a single mold, and which blocks have an aesthetically pleasant exposed front surface. In embodiments of the present invention, it is possible that multiple composite blocks may be formed, where the composite blocks are split into face units with textured facing surfaces. Surfaces of the mold box or the surface of a divider plate inserted into the mold box may be embossed with different patterns so that the facing surfaces of the face units may be embossed with a pattern. Because face units are smaller than entire SRW blocks, and since they are similar to paver blocks, face units may also be manufactured using paving blocks machines and paving block manufacturing techniques. For instance, a separate face mix and base mix may be used to produce a face unit face up in a "Face and Base" paving block machine. In some embodiments, the face mix is a higher quality material, such as new concrete, and the base mix is a relatively lower quality material, such as recycled concrete. Since the base mix portion of the face unit will be hidden from view when constructed into a retaining wall, cost savings may be realized from such a manufacturing technique. In some embodiments, the 90% of the face unit is formed from the lower quality base mix while only 10% is the higher quality face mix. Producing face units in this manner eliminates height control issues found in typical retaining wall block manufacturing processes.

Independent of the manufacturing process used, the face units may be formed of different materials than those used for the anchor units. For instance, since the anchor units will be hidden from view when assembled into a retaining wall, the anchor units may be formed of relatively lower quality materials than the face unit. That is, both may be formed of concrete, but the anchor units may use a higher percentage of recycled materials. Alternatively, the face unit may be formed of concrete while the anchor unit is formed of plastic.

In some embodiments, the anchor units may be seen as generic or universal such that they may connect with many different types and styles of face units. Accordingly, one may retain fewer anchor units in inventory as compared to the number of the universal face units retained. Some embodiments of the invention include a supply of preformed block components for forming a mortarless retaining wall comprised of segmented retaining wall (SRW) blocks. The preformed block components include face units having of differing styles or patterns and universal anchor units that may be interlocked with any of the face units via complementary connector elements.

In the foregoing detailed description, the invention has been described with reference to specific embodiments. However, it may be appreciated that various modifications and changes can be made without departing from the scope of the invention as set forth in the appended claims.

The invention claimed is:

1. A mortarless retaining wall constructed of a plurality of segmented retaining wall (SRW) blocks stacked in an array of superimposed rows, each SRW block comprising:

a face unit having a facing surface defining part of the exposed surface of the retaining wall, the face unit having two connector elements;

an anchor unit having two connector elements each being of complementary shape to the face unit connector elements, the anchor unit confronting soil being retained by the retaining wall;

the anchor unit and the face unit each having upper and lower load bearing surfaces, the upper load bearing surfaces for mating with the lower load bearing surfaces of a super-imposed stacked block, the load bearing surfaces being generally planar to resist shear forces between adjacent SRW blocks, the shear forces applied by the soil retained by the retaining wall against the SRW block, and the anchor unit and face unit interlocked via respective connector elements to form the SRW block, the anchor unit and the face unit, when interlocked, forming a hollow core bounded by inner walls of the anchor unit and the face unit and extending vertically from the upper load bearing surfaces to the lower bearing surfaces.

2. The mortarless retaining wall of claim 1, wherein the face units and the anchor units of some of the SRW block are formed of different materials, the anchor unit being formed of relatively lower quality materials than the face unit.

3. The mortarless retaining wall of claim 2, wherein the anchor units of some of the SRW blocks are formed of recycled materials.

4. The mortarless retaining wall of claim 2, wherein the anchor units of some of the SRW blocks are formed of plastic.

5. The mortarless retaining wall of claim 1, wherein the face units of some of the SRW blocks are formed via a wetcast, a drycast, or an extrusion.

6. The mortarless retaining wall of claim 1, wherein the face unit of some of the SRW blocks are formed using a face and base paver machine, the front surface being formed of a veneer layer of a relatively higher quality material and the remainder of the face unit being formed of a relatively lower quality material.

7. The mortarless retaining wall of claim 1, wherein at least one of the face unit and the anchor unit of some of the SRW blocks are formed of concrete.

8. The mortarless retaining wall of claim 1, wherein the anchor units of some of the SRW blocks are formed in a generally U-shape with the first and second legs of the U-shape terminating in the respective connector elements.

9. The mortarless retaining wall of claim 8, wherein the first and second legs of the generally U-shape of the anchor units of some of the SRW blocks form side walls of the SRW block.

10. The mortarless retaining wall of claim 8, wherein the first and second legs of the generally U-shape of the anchor units of some of the SRW blocks contain recesses forming hand-holds useful when lifting the anchor units.

11. The mortarless retaining wall of claim 8, wherein the first and second legs of the generally U-shape of the anchor units of some of the SRW blocks are connected by two cross-member portions to reinforce the anchor unit.

12. A supply of preformed block components for forming a mortarless retaining wall comprised of segmented retaining wall (SRW) blocks, comprising:

a plurality of face units each having a facing surface defining part of the exposed surface of the retaining wall, the facing surfaces of the plurality of face units having a differing pattern thereon, each face unit having two connector elements;

a plurality of anchor units for confronting soil being retained by the retaining wall, each anchor unit being of a universal design and having two connector elements each being of complementary shape to one of the connector elements of one of the face units;

each anchor unit and face unit capable of being interlocked via respective connector elements to form a segmented retaining wall (SRW) block, each anchor unit and face unit, when interlocked to form a SRW block, form a hollow core oriented vertically and bounded by inner walls of the anchor unit and the face unit and stackable in rows of SRW blocks to form the retaining wall; and the anchor units and the face units each having upper and lower load bearing surfaces, the upper load bearing surfaces for mating with the lower load bearing surfaces of a super-imposed stacked SRW block, the load bearing surfaces being generally planar to resist shear forces between adjacent SRW blocks, the shear forces applied by the soil retained by the retaining wall against each SRW block.

13. The supply of claim 12, wherein some of the face units each include four connector elements.

14. The supply of claim 12, wherein the two connector elements of the anchor units are of the same size.

15. The supply of claim 12, wherein the interlock of the connector elements of each anchor unit and each face unit is loose, allowing for limited relative movement between such anchor unit and such face unit without disconnecting the interlock.

16. A multi-component segmented retaining wall (SRW) block for forming a mortarless retaining wall:

a face unit having a facing surface and a rear surface opposite the facing surface, the facing surface defining part of the exposed surface of the retaining wall, the rear surface being generally planar and having recesses forming two connector elements, an anchor unit having a generally U-shape with first and second legs of the U-shape terminating in respective connector elements each being of complementary shape to the face unit connector elements, the anchor unit confronting soil being retained by the retaining wall;

the anchor unit and the face unit each having upper and lower load bearing surfaces, the upper load bearing surfaces for mating with the lower load bearing surfaces of a super-imposed stacked SRW block, the load bearing surfaces being generally planar to resist shear forces applied by the soil retained by the retaining wall against the SRW block, and the anchor unit and face unit interlocked via respective connector elements to form the SRW block, the anchor unit and the face unit, when interlocked, forming a hollow core oriented vertically and bounded by inner walls of the anchor unit and the face unit.

17. The multi-component SRW block of claim 16, wherein the face unit has opposing side surfaces, at least one of the opposing side surfaces being directly rearwardly inwardly with respect to the facing surface whereby joined adjacent blocks will effect a generally curved front surface to the retaining wall.

18. The multi-component SRW block of claim 17, wherein the other side surface of the at least one of the opposing surfaces being generally perpendicular to the facing wall to create an end block for the retaining wall.

19. The multi-component SRW block of claim 17, wherein both of the opposing side surfaces are directed rearwardly inwardly.

20. The multi-component SRW block of claim 16, wherein the connector elements of the face unit comprise elongated keyways and the connector elements of the anchor unit comprise elongated keys slidable within the keyways.

21. The multi-component SRW block of claim 20, wherein the keyways and the keys extend the entire height of the face unit and anchor unit, respectively, the keyways forming vertical passages in the face unit.

22. The multi-component SRW block of claim 16, wherein the center to center distance of the keys of one anchor unit is equal to the center to center distance of adjacent keyways of two face units positioned adjacent to each other, whereby the anchor unit may interconnect with the two face units positioned adjacent to each other.

23. A mortarless retaining wall constructed of a plurality of segmented retaining wall (SRW) blocks stacked in an array of superimposed rows, each SRW block comprising:

a face unit having a facing surface defining part of the exposed surface of the retaining wall, the face unit having two connector elements;

an anchor unit having two connector elements each being of complementary shape to the face unit connector elements, the anchor unit confronting soil being retained by the retaining wall;

the anchor unit and the face unit each having upper and lower load bearing surfaces, the upper load bearing surfaces for mating with the lower load bearing surfaces of a super-imposed stacked block, the load bearing surfaces being generally planar to resist shear forces between superimposed SRW blocks, the shear forces applied by the soil retained by the retaining wall against the SRW block, and the anchor unit and face unit interlocked via respective connector elements to form the SRW block, the anchor unit and the face unit, when interlocked, forming a hollow core oriented vertically and bounded by inner walls of the anchor unit and the face unit, and at least one of the anchor unit and the face unit having at least one alignment element that aligns and resists the shear forces between a superimposed SRW block relative to its immediately subjacent block.

24. The mortarless retaining wall of claim 23, wherein the at least one alignment element of some of the SRW blocks is one of a lip, notch, pin recess, and slot.

25. The mortarless retaining wall of claim 23, wherein the at least one alignment element of some of the SRW blocks includes a lip of the face units, the lip extending laterally over the face units and at the front thereof, the lip resisting shear forces applied by the soil retained by the retaining wall against the SRW block.

26. The mortarless retaining wall of claim 24, wherein the face units of the some of the SRW blocks include a notch extending laterally under the face units and at the front thereof, the height of the notch being generally less than or equal to the height of the lip.

27. The mortarless retaining wall of claim 25, wherein the laterally extending lip is defined with a depth approximately equal to the depth of the notch such that a vertically extending wall can be formed using such SRW blocks.

28. The mortarless retaining wall of claim 25, wherein the laterally extending lip is defined with a depth greater than the depth of the notch such that the retaining wall formed using such SRW blocks is formed with a setback, whereby the setback depth of each course of blocks is based on the difference in depths between the laterally extending lip and the notch.

29. The mortarless retaining wall of claim 23, wherein the at least one alignment element of some of the SRW blocks includes a lip of the anchor units, the lip extending laterally under the anchor units and at the rear thereof, the lip resisting shear forces applied by the soil retained by the retaining wall against the SRW block.

30. The mortarless retaining wall of claim 27, wherein the anchor units of the some of the SRW blocks include a notch extending laterally over the anchor units and at the rear thereof, the depth of the lip being generally equal to the depth of the notch.

31. The mortarless retaining wall of claim 28, wherein the height of the lip is equal to or less than the height of the notch.

* * * * *